US007513242B2

(12) United States Patent
Morris

(10) Patent No.: US 7,513,242 B2
(45) Date of Patent: Apr. 7, 2009

(54) FUEL INJECTOR ASSEMBLY WITH INJECTOR SEAL RETENTION

(75) Inventor: Corydon E. Morris, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 11/743,956

(22) Filed: May 3, 2007

(65) Prior Publication Data

US 2008/0271713 A1 Nov. 6, 2008

(51) Int. Cl.
*F02M 61/14* (2006.01)

(52) U.S. Cl. ..... 123/470

(58) Field of Classification Search ..... 123/470
See application file for complete search history.

(56) References Cited

U.S. PATENT DOCUMENTS 3,038,456 A * 6/1962 Dreisin ..... 123/470
3,319,325 A * 5/1967 Nessamar et al. ..... 29/235
3,334,617 A * 8/1967 Palkowsky ..... 123/470
4,081,890 A * 4/1978 Bluhm et al. ..... 29/890.142
4,133,321 A * 1/1979 Hofmann et al. ..... 123/470
4,532,893 A 8/1985 Day et al.
4,589,596 A 5/1986 Stumpp et al.
4,647,012 A * 3/1987 Gartner ..... 251/148
4,790,055 A 12/1988 Raufeisen et al.
4,894,900 A 1/1990 Rausfeisen et al.
5,044,340 A 9/1991 Robnett
5,070,767 A * 12/1991 Yuda ..... 92/128
5,094,215 A 3/1992 Gustafson
5,117,743 A * 6/1992 Yuda ..... 92/128
5,335,852 A 8/1994 Muntean et al.
5,394,850 A 3/1995 Murphy et al.
5,487,368 A * 1/1996 Bruning ..... 123/470
5,682,859 A 11/1997 Wakeman
5,724,946 A 3/1998 Franchitto
5,758,985 A * 6/1998 Yuda ..... 403/24
6,116,219 A * 9/2000 Girard ..... 123/470
6,178,950 B1 * 1/2001 Stockner et al. ..... 123/470
6,186,122 B1 2/2001 Leung
6,186,123 B1 * 2/2001 Maier et al. ..... 123/470
RE37,241 E 6/2001 Gustafson
6,286,768 B1 9/2001 Vetters et al.
6,427,667 B1 8/2002 Kato
6,494,465 B1 * 12/2002 Bucknell ..... 277/641
6,499,467 B1 12/2002 Morris et al.
6,557,776 B2 5/2003 Carroll, III et al.
6,807,945 B2 * 10/2004 Reiter et al. ..... 123/470
6,824,081 B2 11/2004 Peters et al.
6,886,539 B2 * 5/2005 Perras ..... 123/470
6,892,707 B2 * 5/2005 Reiter et al. ..... 123/470
6,921,033 B2 * 7/2005 Reiter ..... 239/533.2

(Continued)

OTHER PUBLICATIONS

International Search Report, PCT/US08/62503, Sep. 30, 2008.

*Primary Examiner*—Thomas N Moulis
(74) *Attorney, Agent, or Firm*—Studebaker & Brackett PC; Donald R. Studebaker

(57) ABSTRACT

A fuel injector assembly with injector seal retention includes a fuel injector body including an injector nozzle housing disposed at a distal end of the fuel injector body. The injector body is adapted with a grooved portion to securely capture an injector seal to prevent the loss of the injector seal during installation and/or removal of the fuel injector assembly into an engine cylinder head.

18 Claims, 4 Drawing Sheets

U.S. PATENT DOCUMENTS 6,978,770 B2 12/2005 Rauznitz et al.
7,004,476 B2 * 2/2006 Nakayama et al. ..... 277/591
7,028,918 B2 4/2006 Buchanan et al.
7,069,908 B2 * 7/2006 Ohkubo et al. ..... 123/470
7,104,257 B2 * 9/2006 Kawamoto et al. ..... 123/470
7,117,851 B2 * 10/2006 Tomita ..... 123/470
7,261,089 B2 8/2007 Hoenig et al.
2004/0173186 A1 * 9/2004 Perras ..... 123/470

* cited by examiner

FUEL INJECTOR ASSEMBLY WITH INJECTOR SEAL RETENTION

FIELD OF THE INVENTION

The present invention relates generally to fuel injector seal assemblies. More particularly, the present invention relates to a fuel injector assembly having secure injector seal retention.

BACKGROUND OF THE INVENTION

In most fuel supply systems applicable to internal combustion engines, fuel injectors are used to direct fuel pulses into the engine combustion chamber. A commonly used injector is a closed-nozzle injector which includes a nozzle assembly having a spring-biased nozzle valve element positioned adjacent the nozzle orifice for resisting blow back of exhaust gas into the pumping or metering chamber of the injector while allowing fuel to be injected into the engine cylinder. The nozzle valve element also functions to provide a deliberate, abrupt end to fuel injection thereby preventing a secondary injection which causes unburned hydrocarbons in the exhaust. The nozzle valve is positioned in a nozzle cavity and biased by a nozzle spring to block fuel flow through the nozzle orifices. In many fuel systems, when the pressure of the fuel within the nozzle cavity exceeds the biasing force of the nozzle spring, the nozzle valve element moves outwardly to allow fuel to pass through the nozzle orifices, thus marking the beginning of injection.

Furthermore, fuel injectors have been commonly used with internal combustion engines such as diesel engines to deliver combustible fuel to the combustion chambers within the cylinders of the engine. Various injector designs have been implemented in the art but most fuel injectors have a nozzle with a valve element movably disposed therein which when opened, provides a spray of fuel into the combustion chamber of the cylinder. In this regard, fuel injectors typically include a nozzle including an outer barrel, a retainer, an injector seal and an injector nozzle housing that houses the valve element of the fuel injector. The fuel injector is typically mounted in an injector bore in the cylinder head of the internal combustion engine with the nozzle orifices generally extending at least partially into the combustion chamber so that fuel may be provided therethrough. In this regard, the retainer and the injector seal are received within the injector bores of the cylinder head and includes an opening proximate to the combustion chamber of the engine cylinder which allows the nozzle housing to extend into the combustion chamber. The injector seal is positioned around the injector nozzle and compressed between the nozzle and the cylinder head within the bore, thereby effectively sealing or inhibiting any expanding gases from escaping through the injector bore of the cylinder head from the combustion chamber during engine operation.

The injector seal may be configured as a circular ring to slide axially on an injector nozzle housing having an outer diameter until the injector seal attains an interference fit on the injector nozzle housing outer diameter. The interference fit is predetermined by the dimensions at a location on the injector nozzle housing outer diameter that is preferably proximate a cylinder head sealing face and an injector sealing face in order to, in effect, clamp or sandwich the injector seal between the sealing faces upon assembly. The use of an interference fit has not been an effective method to capture the injector seal. For instance, if the injector seal shifts or is moved from the predetermined interference fit location on the injector nozzle housing outer diameter, the injector seal may fall off the injector nozzle housing or get stuck within the injector bore itself upon removal of the fuel injector from the bore during disassembly.

However, there still exists a need for an improved fuel injector assembly with an injector seal retention having a nozzle and injector seal combination with improved injector seal retention. In particular, there exists an unfulfilled need for such a nozzle that will more securely capture the injector seal during installation and/or removal of a fuel injector into and from an engine cylinder head or injector bore. In this regard, there is a need for such a nozzle configuration which securely captures the injector seal, thereby preventing the injector seal from being lost, avoiding any inadvertent disengagement of the injector seal from the injector nozzle housing, and/or the injector seal remaining within the injector bore upon removal of the fuel injector making seal removal difficult, time consuming and costly. Further, a configuration to properly capture the injector seal may result in minimizing misalignment of the injector nozzle during assembly Accordingly, it is desirable to provide a method and apparatus that will capture the injector seal on the injector nozzle housing even during installation and/or removal of the fuel injector.

SUMMARY OF THE INVENTION

The foregoing needs are met, to a great extent, by the present invention, wherein in one aspect an apparatus is provided that in some embodiments provides a method and apparatus that will retain or capture an injector seal on an injector nozzle housing even during installation and/or removal of the fuel injector.

In accordance with one aspect of the present invention, a fuel injector assembly for mounting in an engine cylinder head of an internal combustion engine by an axial clamping load is provided including an elongated fuel injector body including an injector nozzle housing positioned at a distal end of the fuel injector body, the fuel injector body including a grooved portion formed in an outer diameter of the fuel injector body proximate the injector nozzle housing; an injector sealing face formed on the injector body; and an injector seal positioned in the grooved portion on the outer diameter of the fuel injector body and dimensioned to extend adjacent the injector sealing face for receiving the axial clamping load upon mounting of the fuel injector assembly in the engine cylinder head.

In accordance with another aspect of the present invention, an engine including a fuel injector system for operating in an engine cylinder head is provided including an elongated fuel injector body including an injector nozzle housing positioned at a distal end of the fuel injector body, the injector nozzle housing including a grooved portion formed in an outer diameter of the injector nozzle housing; an injector sealing face formed on the injector body; and an injector seal positioned in the grooved portion on the outer diameter of the injector nozzle housing and dimensioned to extend adjacent the injector sealing face, the injector seal being positioned proximate the injector sealing face and at a lower portion of the injector nozzle housing.

In accordance with still another aspect of the present invention, a method of sealing a fuel injector assembly within an engine cylinder head of an internal combustion engine is provided including the steps of providing an injector seal; providing a grooved portion located on an outer diameter of a fuel injector body at a final position of the injector seal, wherein the diameter of an inner annular diameter of the injector seal is sized to create an interference fit with the outer diameter of the fuel injector body; sliding the injector seal in an axial direction along the outer diameter of the fuel injector body causing an interference fit with the outer diameter; snapping the injector seal into the grooved portion; capturing the injector seal within the grooved portion, wherein the injector seal is adapted to spring back once within the grooved portion; and inserting the fuel injector assembly into an injector bore located in the engine cylinder head.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1A:
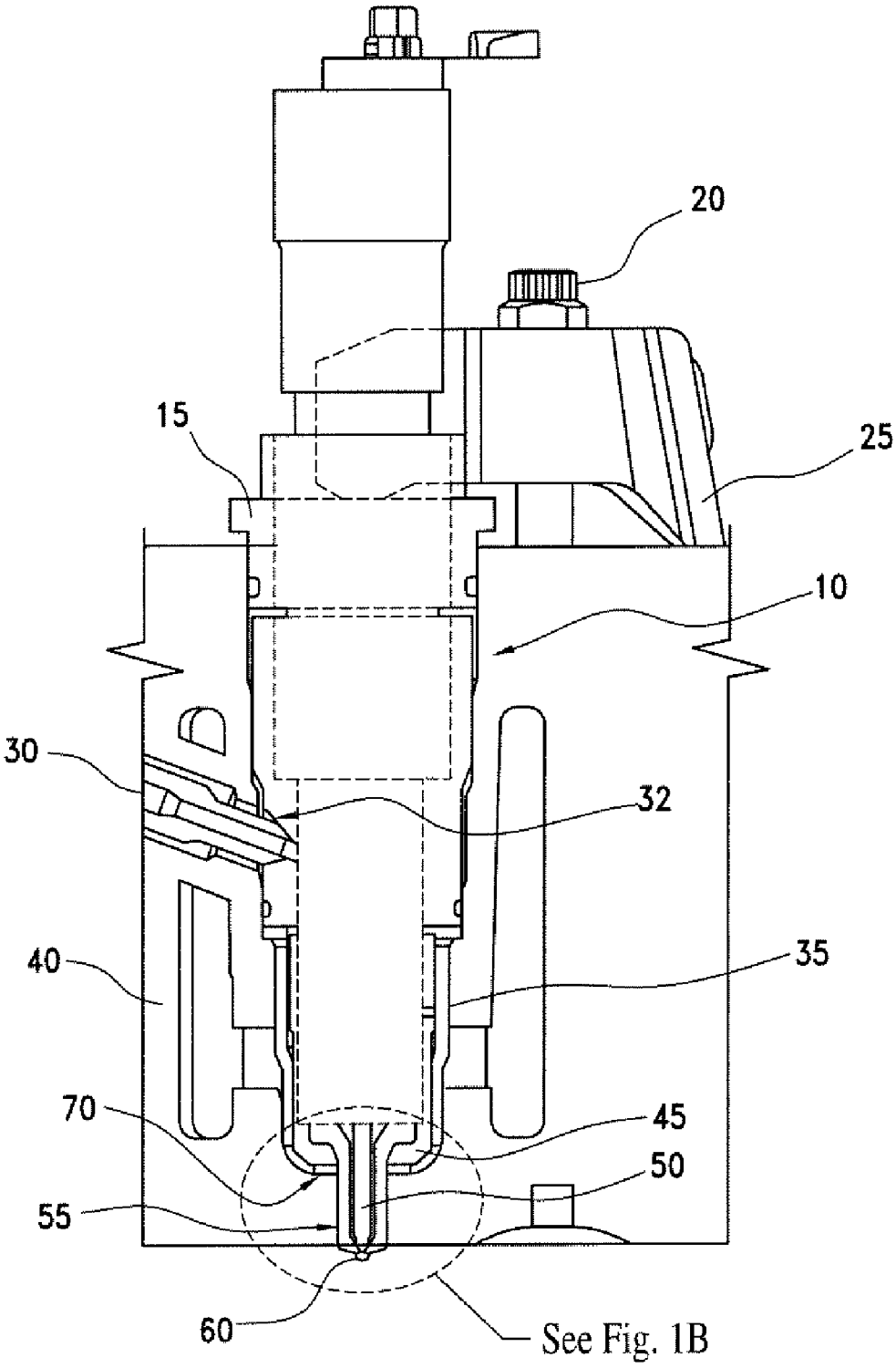
FIG. 1A is a partially schematic and partially cross-sectional view of the fuel injector assembly having an improved nozzle and injector seal combination mounted within an engine cylinder head in accordance with one embodiment of the present invention.

The invention will now be described with reference to the drawing figures, in which like reference numerals refer to like parts throughout. An embodiment in accordance with the present invention provides a fuel injector assembly including injector seal retention.

Referring to FIG. 1A, the fuel injector assembly 10 of the present invention includes a typical electrically operated fuel injector body 15 positioned and held within an injector bore 35 of an engine cylinder head 40 of an internal combustion engine (not shown) by a clamp hold down 25 with a clamp hold down bolt 20. Fuel injector body 15 includes an injector nozzle housing 55 having a nozzle tip 60 disposed at a distal end of fuel injector body 15 and held in place by means of a nozzle retainer 45. A fuel inlet supply 30 is fluidly connected to fuel injector body 15 through engine cylinder head 40 by conventional means to direct fuel from a fuel source (not shown) to an injector cavity 32. The injector nozzle housing 55 may have a number of nozzle orifices 59 disposed at nozzle tip 60 to inject fuel through engine cylinder head 40 during operation. A valve element 50 is movably mounted with injector nozzle housing 55 to allow and control the flow of fuel from nozzle orifices 59 into, for example, a combustion chamber or intake duct as needed. In order to properly seal fuel injector body 15 within engine cylinder head 40, an injector seal 70 is mounted on injector body 15 for sealing abutment between injector body 15 and cylinder head 40 as described hereinbelow. Injector seal 70 can be configured to be captured on injector body 15, i.e., injector nozzle housing 55, within a grooved portion 75 to maintain the desired sealing characteristics. Injector seal 70 may be a cylindrical ring or washer shape.

Figure 1B:
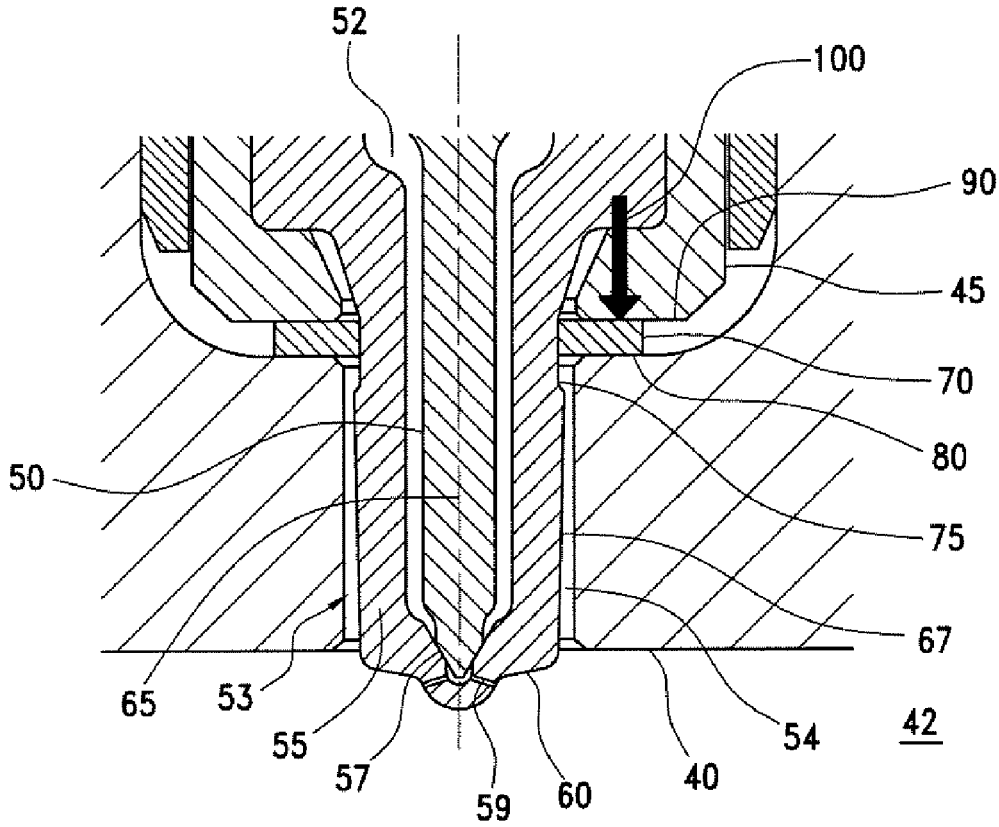
FIG. 1B is an enlarged cross-sectional view illustrating the fuel injector nozzle of the fuel injector as shown in FIG. 1A.

Referring to FIG. 1B, injector nozzle housing 55 includes an outer diameter (OD) 67 including grooved portion 75 positioned at the final installed injector seal location. Injector nozzle housing 55 may have a nozzle longitudinal axis 65 directed along the length of fuel injector body 15. Valve element 50 coincides with longitudinal axis 65 within nozzle housing 55. When valve element 50 is in the closed position, it abuts valve seat 57 adjacent nozzle orifices 59. Valve element 50 is spaced from valve seat 57 when in the open position, thereby allowing fuel to flow through orifices 59 accordingly. Valve element 50 is movably mounted within a cavity 52 inside injector nozzle housing 55. Injector housing is disposed within an engine cylinder head bore 53. Engine cylinder head bore 53 is open to a combustion chamber 42 whereby combustion gases may enter bore 53 passing nozzle housing 55 via an annular gap or space 54 located around nozzle housing 55 until injector seal 70 is encountered thereby effectively closing gap 54 and sealing the remainder of fuel injector body 15 within injector bore 35 from any escaping combustion chamber gases.

Figure 3:
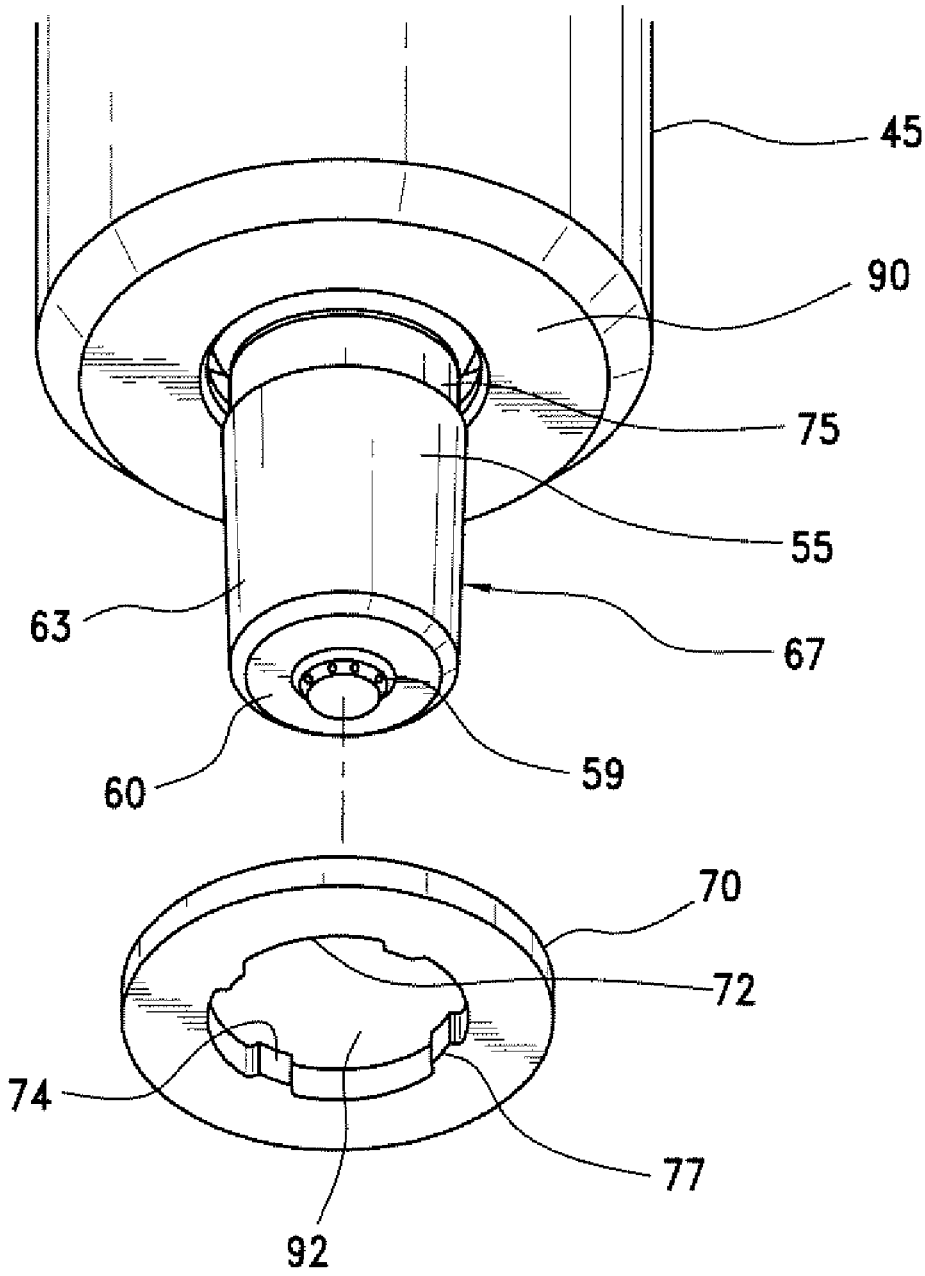
FIG. 3 is an exploded perspective view illustrating the invention of FIG. 1B prior to assembly.

Referring to FIGS. 1B and 3, injector seal 70 may be made of relatively soft metallic material having characteristics with adequate elastic deformation of the metal to allow for a spring-back effect. Injector seal 70 may be annular or ring-shaped having a central opening 92 for allowing injector nozzle housing 55 to pass through upon assembly. Injector seal 70 creates the seal between a cylinder head sealing face 80 and an injector sealing face 90 when an applied axial clamping load 100 is applied to fuel injector body 15. Injector sealing face 90 is adapted to abut injector seal 70 and may be located at a distal end of fuel injector body 15 adjacent injector nozzle housing 55. Injector seal 70 has a width between the injector seal inner and outer diameter sufficient to extend from grooved portion 75 to a position between injector sealing face 90 and cylinder head sealing face 80. The cross-sectional shape of the annular ring forming the injector seal 70, shown in detail in FIG. 1B, may be rectangular. Grooved portion 75 may be an annular detent located circumferentially around injector nozzle housing 55 at a lower portion of nozzle housing 55 in order to provide the maximum contact surface for securely capturing injector seal 70.

Nozzle outside diameter (OD) 67 may be straight or tapered, however a tapered portion 63, with the small diameter of taper portion 63 starting at nozzle tip 60, may be preferable in order to more easily apply injector seal 70 during the assembly of fuel injector assembly 10 prior to installation into engine cylinder head 40. The diameter of grooved portion 75 is smaller than nozzle OD 67 at the outermost diameter when tapered. The outermost diameter of nozzle OD 67 may be configured to create an interference fit with an inner hole diameter 77 of injector seal 70 as injector seal 70 is moved from nozzle tip 60 towards injector sealing face 90 during assembly. Once injector seal 70 is snapped into nozzle groove 75, the interference is relieved and injector seal 70 is securely captured.

Figure 2:
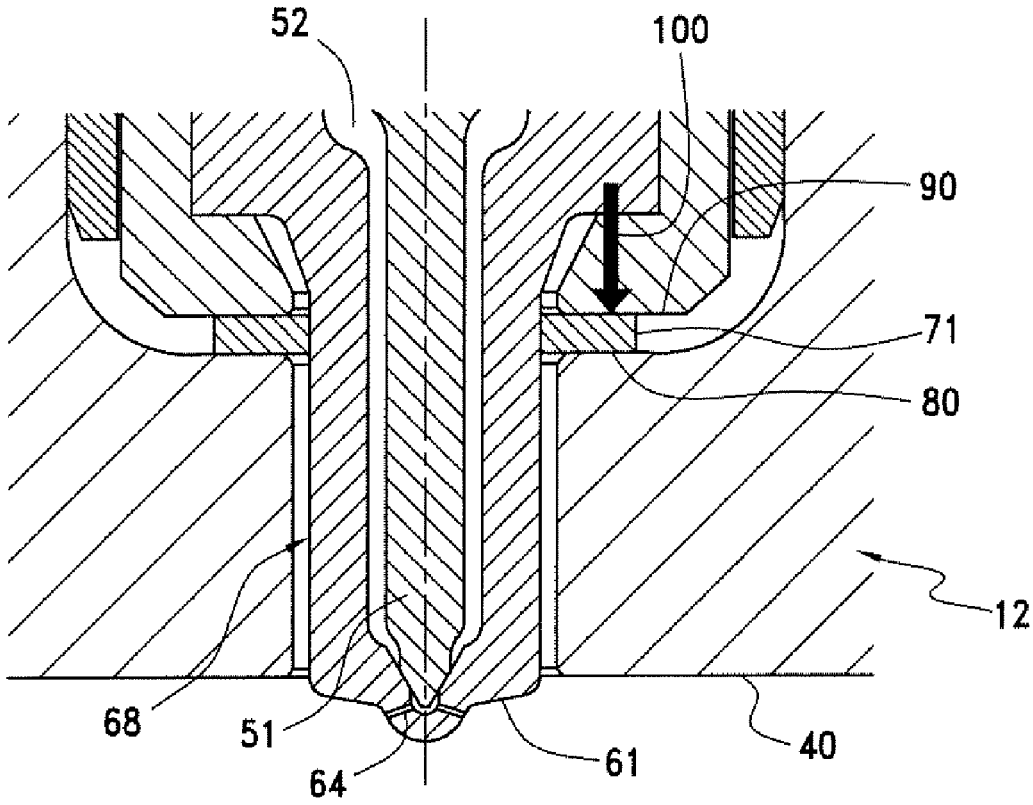
FIG. 2 (PRIOR ART)
FIG. 2 is a cross-sectional view illustrating a conventional fuel injector nozzle assembly installed in an engine cylinder head.

Referring to FIG. 2, a conventional fuel injector assembly 12 may include a conventional nozzle housing 68 having a nozzle tip 61 with nozzle orifices 64, a valve element 51 and a conventional injector seal 71 utilizing a press or interference fit alone when mounted on nozzle housing 68. Upon assembly, injector seal 71 may be clamped or sandwiched between engine cylinder head sealing face 80 and injector sealing face 90 with an appropriate injector axial clamping load 100 applied. In this configuration, injector seal 71 may come off nozzle housing 68 during fuel injector assembly 12 installation and/or removal from engine cylinder head 40.

With respect to the present invention and referring again to FIG. 3, injector seal 70 may be assembled to injector nozzle housing 55 before fuel injector assembly 10 is installed in engine cylinder head 40. Injector seal 70 may be pressed onto injector nozzle housing 55 until it is bottomed against the injector seal face 90. Inner hole diameter 77 is defined by inner portions 74 of injector seal 70 being smaller than nozzle OD 67, resulting in an interference fit. When injector seal 70 passes over nozzle OD 67, the seal material stretches elastically resulting in some spring-back when injector seal 70 reaches grooved portion 75 in nozzle OD 67. This spring-back results in capturing injector seal 70 with inner portions 74 being slightly smaller than nozzle OD 67 at the edge of grooved portion 75 which may prevent injector seal 70 from easily falling off or being removed from injector nozzle housing 55.

Injector seal 70 may also deform plastically during assembly if the material yield strength is exceeded, but a certain amount of elastic spring-back will still occur thus preventing injector seal 70 from falling off injector nozzle housing 55. Plastic deformation of injector seal 70 may be achieved by selecting the appropriate part geometry, tolerances and material properties of the associated parts. The use of plastic deformation of injector seal 70 may allow the use of larger tolerances on inner portions 74 of injector seal 70 and nozzle OD 67.

The use of tapered portion 63 on nozzle OD 67 can avoid excessive material shearing of inner portions 74 of the relatively soft injector seal 70 as it passes over nozzle OD 67 resulting in improved seal retention. Tapered portion 63 can also allow for easier assembly of injector seal 70 if the small end of tapered portion 63 is smaller than an inner hole diameter 77 defined by inner portions 74 of injector seal 70.

Injector seal 70 may have any number of relieved portions 72 in inner hole diameter 77. Although an example of the injector seal 70 is shown using four relieved areas 72, it will be appreciated that other configurations can be used. For example, the inner hole diameter 77 of seal 70 may be constant without any relived portions. If present, these relieved areas 72 reduce the injector seal assembly stress by allowing the injector seal material to not only stretch in tension but also to bend. As a result, there is less material yielding providing additional spring-back of inner hole diameter 77 and additional injector seal 70 retention capability.

Referring again to FIG. 3, the invention provides the following features which result in injector seal 70 being captured on injector nozzle housing 55 while providing easy assembly: 1) grooved portion 75 on nozzle OD 67 at the final position of injector seal 70; 2) inner hole diameter 77 of injector seal 70 may be sized to create an interference fit with nozzle OD 67; and may have 3) tapered portion 63 on nozzle OD 67 with the small diameter of taper portion 63 starting at nozzle tip 60; and/or 4) relieved portions 72 disposed within inner hole diameter 77.

During assembly, injector seal 70 may be pressed onto injector nozzle housing 55, and injector seal 70 may elastically deform outwardly as it moves along nozzle OD 67. Injector seal 70 may also plastically deform in the same manner. When injector seal 70 reaches grooved portion 75 on nozzle OD 67, injector seal 70 springs back into grooved portion 75 and is thereby securely captured. In this manner, injector seal 70 cannot accidentally come off injector nozzle housing 55 during assembly and disassembly.

In operation, injector seal 70 is place on injector nozzle housing 55 about the nozzle longitudinal axis 65 and an interference fit is applied on injector seal 70 until it snaps into place within grooved portion 75. With injector seal 70 fully captured in place about injector nozzle housing 55, fuel injector body 15 is placed within injector bore 35 of engine cylinder head 40. Next, injector axial clamping load 100 is placed upon fuel injector body 15 by clamp hold down 25 in combination with adjustable clamp hold down bolt 20. This axial clamping load 100, when applied, causes injector seal 70 to compress between engine cylinder head 40 and injector sealing face 90 Once fuel injector assembly 10 is completely adjusted and secured to engine cylinder head 40, fuel injection may begin via fuel inlet supply 30 in combination with conventional fuel injector controls and operations.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

I claim:

1. A fuel injector assembly for mounting in an engine cylinder head of an internal combustion engine by an axial clamping load, comprising:

an elongated fuel injector body including an injector nozzle housing positioned at a distal end of the fuel injector body, said fuel injector body including a grooved portion formed in an outer diameter of the fuel injector body proximate the injector nozzle housing;

an injector sealing face formed on the injector body; and an injector seal positioned in the grooved portion on the outer diameter of the fuel injector body and dimensioned to extend adjacent the injector sealing face for receiving the axial clamping load upon mounting of the fuel injector assembly in the engine cylinder head.

2. The fuel injector assembly of claim 1, wherein the injector nozzle housing includes a tapered portion.

3. The fuel injector assembly of claim 1, wherein the injector seal is clamped between the injector sealing face and an engine cylinder head sealing face located opposite the injector sealing face while under the axial clamping load.

4. The fuel injector assembly of claim 1, wherein the injector seal is a cylindrical annular disc including a central orifice.

5. The fuel injector assembly of claim 4, wherein the central orifice is adapted to interference fit on the outer diameter of the fuel injector body and to spring-back upon placement within the grooved portion.

6. The fuel injector assembly of claim 4, wherein the central orifice of the injector seal is configured with at least one inwardly radial protrusion.

7. The fuel injector assembly of claim 5, wherein the grooved portion is an annular detent disposed circumferentially around the fuel injector body.

8. An engine including a fuel injector system for operating in an engine cylinder head, comprising:

an elongated fuel injector body including an injector nozzle housing positioned at a distal end of the fuel injector body, said injector nozzle housing including a grooved portion formed in an outer diameter of the injector nozzle housing;

an injector sealing face formed on the injector body; and an injector seal positioned in the grooved portion on the outer diameter of the injector nozzle housing and dimensioned to extend adjacent the injector sealing face, the injector seal being positioned proximate the injector sealing face and at a lower portion of the injector nozzle housing.

9. The engine of claim 8, wherein the injector nozzle housing includes a tapered portion.

10. The engine of claim 8, wherein the injector seal is clamped between the injector sealing face and an engine cylinder head sealing face located opposite the injector sealing face while under an axial clamping load.

11. The engine of claim 8, wherein the injector seal is a cylindrical annular disc including a central orifice.

12. The engine of claim 11, wherein the central orifice is configured to interference fit within the grooved portion of the injector nozzle housing.

13. The engine of claim 12, wherein the grooved portion is an annular detent disposed circumferentially around the injector nozzle housing.

14. The engine of claim 11, wherein the central orifice of the injector seal is configured with at least one inwardly radial protrusion.

15. A method of sealing a fuel injector assembly within an engine cylinder head of an internal combustion engine, comprising:

providing an injector seal;

providing a grooved portion located on an outer diameter of a fuel injector body at a final position of the injector seal, wherein the diameter of an inner annular diameter of the injector seal is sized to create an interference fit with the outer diameter of the fuel injector body;

sliding the injector seal in an axial direction along the outer diameter of the fuel injector body causing an interference fit with the outer diameter;

snapping the injector seal into the grooved portion;

capturing the injector seal within the grooved portion, wherein the injector seal is adapted to spring back once within the grooved portion; and inserting the fuel injector assembly into an injector bore located in the engine cylinder head, and applying an axial clamping load to the injector seal once the injector seal is inserted into the engine cylinder head, and wherein the injector seal is dimensioned to extend adjacent the injector sealing face for receiving the axial clamping load upon mounting of the fuel injector assembly in the engine cylinder head.

16. The method of claim 15, wherein the injector body includes an injector nozzle located at a lower portion of the injector body and adapted to include a tapered portion at a distal end.

17. The method of claim 15, wherein the injector seal is a cylindrical annular disc including a central orifice.

18. The method of claim 17, wherein the inner diameter of the annular disc is adapted to include at least one relieved portion therein.

* * * * *